United States Patent [19]

Taylor

[11] Patent Number: 4,927,021

[45] Date of Patent: May 22, 1990

[54] INSTALLER'S BRIEFCASE

[76] Inventor: Steven C. Taylor, 1413 Kesser Dr., Plano, Tex. 75023

[21] Appl. No.: 53,621

[22] Filed: May 26, 1987

[51] Int. Cl.[5] ..... B65D 85/28

[52] U.S. Cl. ..... 206/373; 206/379; 206/563; 220/22

[58] Field of Search ..... 206/216, 223, 372, 373, 206/374, 375, 379, 562, 563, 349; 220/20, 21, 22; 312/DIG. 33

[56] References Cited

U.S. PATENT DOCUMENTS

| | | | |
|---|---|---|---|
| 716,003 | 12/1902 | Diehl | 206/373 |
| 1,933,894 | 11/1933 | Clink | 206/373 X |
| 3,003,618 | 10/1961 | Lebedzinski | 206/373 |
| 3,327,841 | 6/1967 | Schurman et al. | 206/349 |
| 3,815,614 | 6/1974 | Waters et al. | 206/349 X |
| 4,380,293 | 4/1983 | Wilcox et al. | 206/563 |
| 4,619,363 | 10/1986 | Wolfseder | 206/373 |

FOREIGN PATENT DOCUMENTS

| | | | |
|---|---|---|---|
| 657299 | 12/1964 | Belgium | 206/373 |
| 2605367 | 8/1977 | Fed. Rep. of Germany | 206/349 |
| 2634636 | 2/1978 | Fed. Rep. of Germany | 206/349 |
| 858393 | 11/1940 | France | 206/373 |
| 596992 | 1/1948 | United Kingdom | 206/373 |
| 1090001 | 11/1967 | United Kingdom | 206/373 |

*Primary Examiner*—Bryon P. Gehman

*Attorney, Agent, or Firm*—Seed & Berry

[57] ABSTRACT

The purpose of this invention is to provided for shipping, storing and using various tools in a single unit that is convenient for both the shipper and the user. A case is provided with rigid outside walls and inside walls dividing the case into many different compartments. One compartment is made specifically to hold a power tool such as a drill. Other compartments are specifically shaped to hold a flashlight, extra batteries and battery charger. The specifically designed compartments for holding the power tool, flashlight, extra batteries and battery charger are made of such a size that they will fit many different sizes and shapes of the respective tool. The compartment for holding the drill is shaped to also hold a different power tool at the same time it is holding one power tool, such as a drill and a staple gun, in a nested relationship. The compartments are organized such that the ones for holding fasteners or tools often used are at the front and the compartment for holding the less frequently used items, such as the flashlight and spare battery, are at the rear of the case.

6 Claims, 7 Drawing Sheets

INSTALLER'S BRIEFCASE

BACKGROUND AND SUMMARY OF THE INVENTION

The present invention is in the field of shipping, storing and using tools. It provides a single case that is useful for shipping certain tools, storing those and other tools when not in use, and convenient and easy access by the worker when the tools are being used.

It is an object of this invention to provide a single case that can store many different sizes of drills in the same compartment according to the user's tastes and needs.

It is a further object of this invention to provide the same case with a compartment for storing different sizes of flashlights, batteries, and battery chargers in their respective compartments according to the user's tastes and needs.

It is a further object of this invention to provide compartments that are frequently used by the worker in an easy access position and those that are less often used at the rear of the case.

It is a further object of this invention to provide a case that has all the herein mentioned advantages and features for the benefit of the shipper and manufacturer in addition to being for the benefit of the worker.

It is a further object of the invention to provide protection for electric or other power tools during shipping to prevent damage to such tools and permit such tools to be easy to pack and prepare by the shipper. Upon receipt by the worker the same case may be used to store the tools in his daily use of the tools as well as to store additional tools and fasteners at the discretion of the worker.

DETAILED DESCRIPTION OF THE INVENTION

Figure 1:
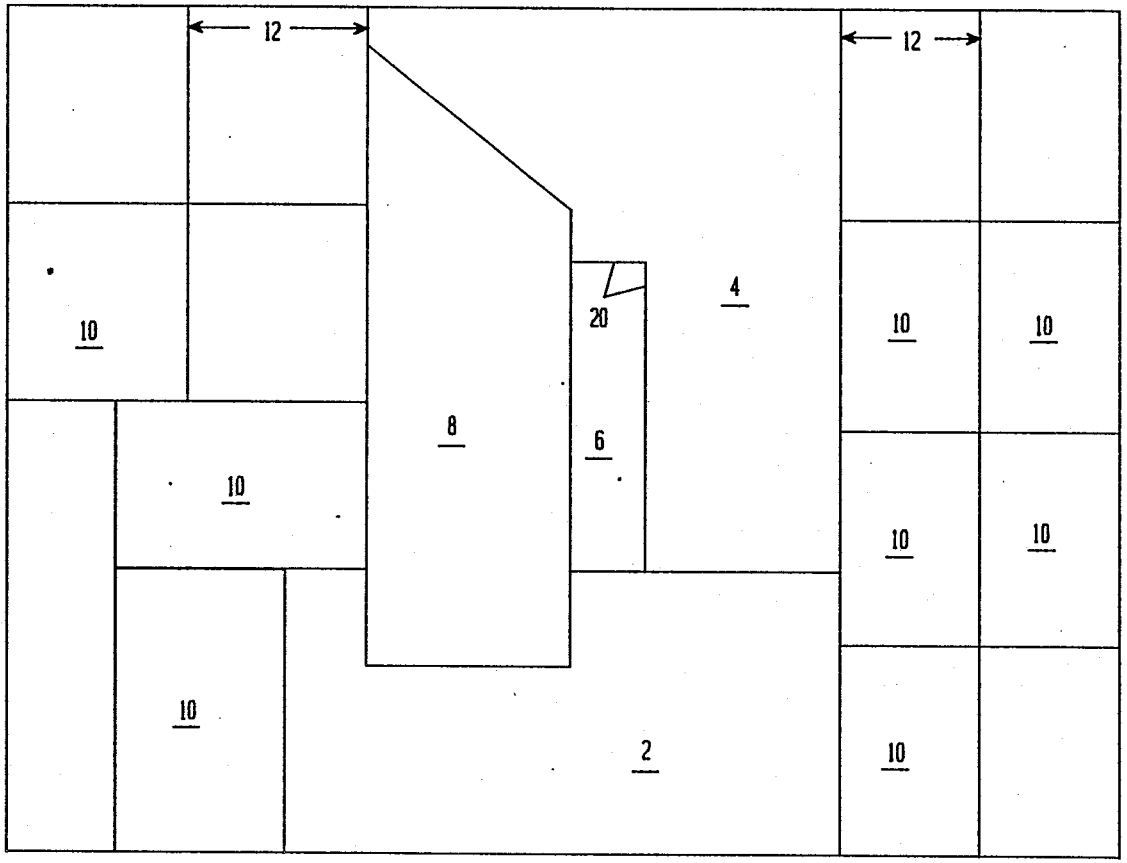
FIG. 1 PRIOR ART
FIG. 1 is a top side view of a device that is presently on the market.

Many types of workers require the use of drills, screwdrivers, screws, screw driver drill bits, staple guns, power tools, clamps and fasteners of various types in their daily work. Some workers can sit at one location and use these items but many types of workers must change locations many times a day or even more in performing their jobs. Both types of workers have need of a place to retain their tools during the day while using them frequently and also have need of a storage place for their tools when not in use. Such workers also have need of a safe place to hold or secure their tools, attachments, fasteners, etc. while in transit to or from the job site. The tools and attachments must be secured in such a way that they will not be destroyed or have their life shorten by damage in transit. This invention fills that need for such workers.

There is available and widely used by such workers, telephone repair men, etc. tools for use in their work including drills, screwdriver drill bits, and fasteners made by various companies. There is also presently available a set of specially designed tools including special drills, batteries, battery chargers and flashlights sold under the name Makita and marketed by a company called Makita Electric Works, Ltd. of Japan.

The Makita company makes two distinctly different systems for use by the worker or telephone repair man, one system is known as a 7.2 volt system and a second system is known as a 9.6 volt system. Both of these systems have special battery packages that are encased, one being a 7.2 volt battery package and the other 9.6 volt battery package. The 9.6 volt battery is significantly larger and differently shaped from the 7.2 volt battery. Both of the systems have a special battery charger that is made specifically for either the 7.2 volt or 9.6 volt battery. The charger for the 9.6 volt battery is a different size then the 7.2 volt battery charger.

Both of these systems have an electric drill and flashlight powered by the respective battery of the system. The flashlight and electric drill of the 7.2 volt system are smaller and differently shaped than those of the 9.6 volt system. In addition, they have different features, such as the rotating head of the flashlight of the 7.2 volt system versus the non-rotating head of the flashlight of the 9.6 volt system which uses a different method to diffuse or deflect the light if desired rather than rotating the head. There are other differences between the 7.2 volt system and 9.6 volt system both sold by Makita that make them very different from each other.

Even greater than the differences between the two systems offered by Makita are the systems and components offered by many different manufacturers. For example, many other companies sell drills that are suitable for use by the worker that may be battery or electric cord powered. Black and Decker, Skill, Sears and others sell drills that are useful to the worker but have very different sizes and shapes from both the 7.2 volt and 9.6 volt drills and systems offered by Makita. Similarly, other companies sell flashlights, batteries, battery packages and battery chargers of different sizes, shapes and configurations, many of which are desirable for use by the worker.

Other power tools are often used by the worker in addition to the drills, flashlights, such as a staple gun or nail driver. A power tool includes these tools and any tool that has an energy assist or energy storage device such as an electric drill, whether by cord or battery, a spring type staple gun, cartridge or gun powder powered staple gun or nail driver, compressed air tools and the like. A power tool does not include items such as a screw driver, pulley, block and tackle system, drill bit, lever etc. that may be useful but are not power tools.

FIG. 1 shows the top side view of a case that is presently being sold in the U.S. It has been on sale less than one year, on information and belief. It is called the Quick Kit and is being sold by C and H Tool Supply Inc., 4591 West 5540 South, Salt Lake City, Utah 84118, Telephone (801) 966-0261 according to information and markings found in the case. This case has some use as a tool storage device but has significant differences and disadvantages in many respects.

The case of FIG. 1 is a case that is designed to hold only the 7.2 volt system sold by Makita. Drills made by other companies such as Black and Decker, Skill, Sears, etc. will not fit into this case. This is a serious disadvantage for the American worker. Further, parts of the 9.6 volt system sold by Makita will not even fit into this case, including the drill, battery charger, etc. For example, compartment 2 is designed to store a flashlight of the 7.2 volt system and requires that the head of the flashlight be bent at a 90 degree angle prior to placing the flashlight in the case. The flashlight which this compartment is designed to hold is of such a length that it cannot be stored in its straight position but requires rotating the head 90 degrees prior to placing it in the case and then upon removal rotated back 90 degrees so it is straight for use. This has the additional disadvantage that only flashlights having swivel or rotating heads or very short flashlights, shorter than standard battery packages for flashlights, can be stored in this compartment. Further, only the flashlight of the 7.2 volt system sold by Makita as described above can be placed in this compartment, the flashlight of the 9.6 volt system does not have a rotating head and hence cannot be stored in this case.

Other compartments of this case have similar disadvantages. The compartment designed to hold the drill, 4, will hold only the Makita 7.2 volt system drill. It will not hold other drills made by other companies nor even the 9.6 volt drill made by Makita which is somewhat larger. Of great significance to the worker is that when the 7.2 volt drill is in compartment 4 no other tool may fit into the same compartment. It is a very tight and exclusive fit. Many workers have frequent need for a staple gun and would like to store it in the same case and carry it with the drill but the staple gun will not fit with the drill in this compartment nor with the flashlight or battery charger. Further there is no compartment of the case of FIG. 1 that will permit storage of a staple gun. All of the compartments provided are the wrong size and shape. Even if all compartments are empty, a staple gun does not fit into this case.

Compartment 6 is for holding the 7.2 volt battery package and compartment 8 is for holding the battery charger of the 7.2 volt battery. Each of these compartments will hold no other battery packages or battery chargers. The other compartments are labeled generally as 10.

The case of FIG. 1 has half circle slots for holding long drill bits across the back of the case shown at 12. The lid, with hinges, not shown, attaches to the rear wall 14, and a handle on the front wall, 16. There are also provided very short, ½ of an inch high, strength reinforcement ribs within compartment 2 that attach to the front wall 16, and the walls of compartment 8 and compartment 4 and the bottom, which are not shown.

FIG. 1 is drawn to scale with all compartments in the exact relationship and size of the case as sold. One inch in the drawing equals 2.46 inches in the case. Each of the outer walls, has a height of 2 inches and the inner walls separating the compartments have a height of 2¾ inches. The two inner walls of compartment 6 for holding the battery package, 20, are only ½ of an inch high.

Figure 2:
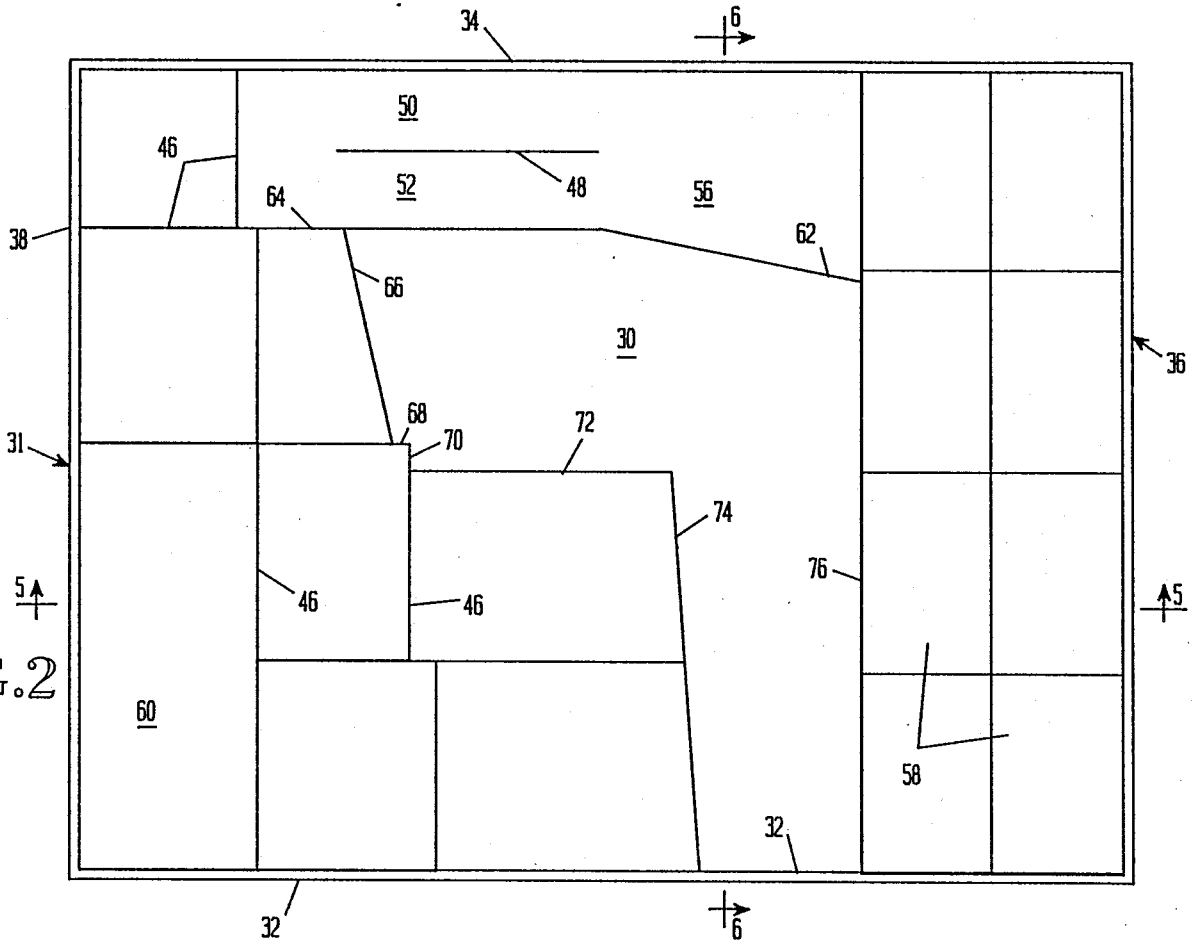
FIG. 2 is a top side view of an alternative embodiment the present invention.

FIG. 2 is top side view of the present invention with no tools shown stored therein.

The compartment 30 is shaped to retain many different sizes and shapes of drills. This means that any one drill will fit into compartment 30 at one time and that to store a different drill in this compartment of a different size or shape the first drill must be removed and the other drill put in compartment 30. This compartment 30 is made to hold a staple gun at the same time one drill is being retained. The staple gun and drill will be enclosed in the compartment at the same time. When an item is enclosed in this case or in a compartment the lid is shut in a tight, enclosing relationship with the bottom of the case. To be enclosed an item must be held on all sides, that is, each of the three dimensions must be restrained. When an item is retained it is sufficient if it is held in place or in a stable condition such as being retained by two walls and a bottom with no top and possibly no other walls. Other power tools such as a nail driver can be retained and/or enclosed in this compartment 30 in place of the drill and can be retained at the same time a second power tool is in the compartment such as a staple gun or as the single item in the compartment.

Figure 3:
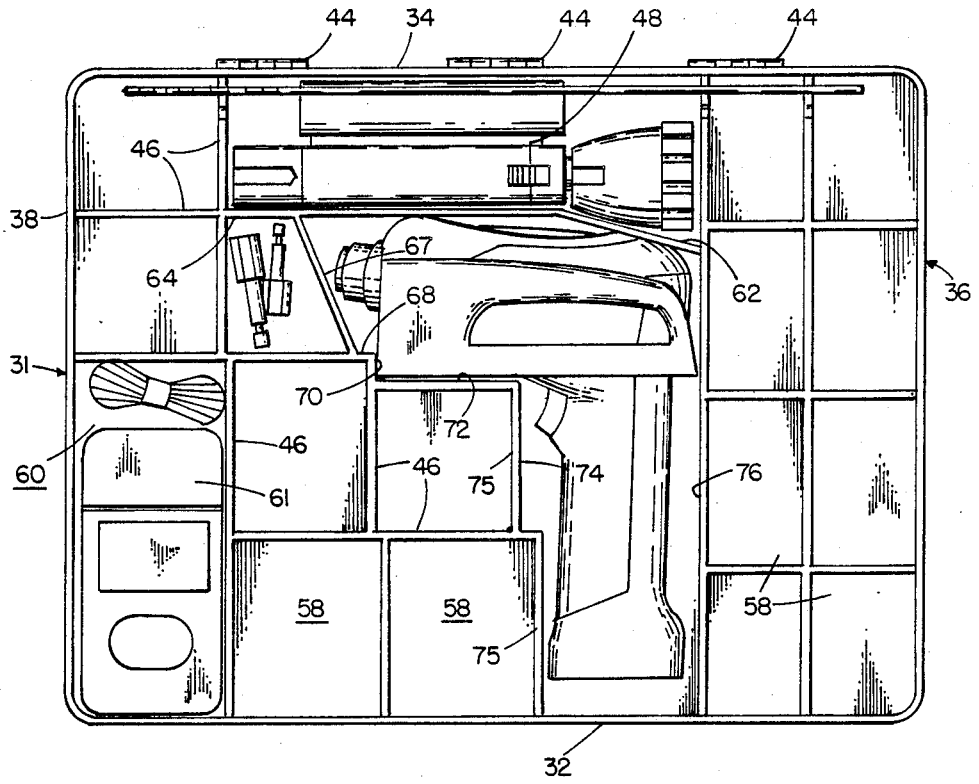
FIG. 3 is a top side view of the present invention shown having various tools stored therein.
Figure 4:
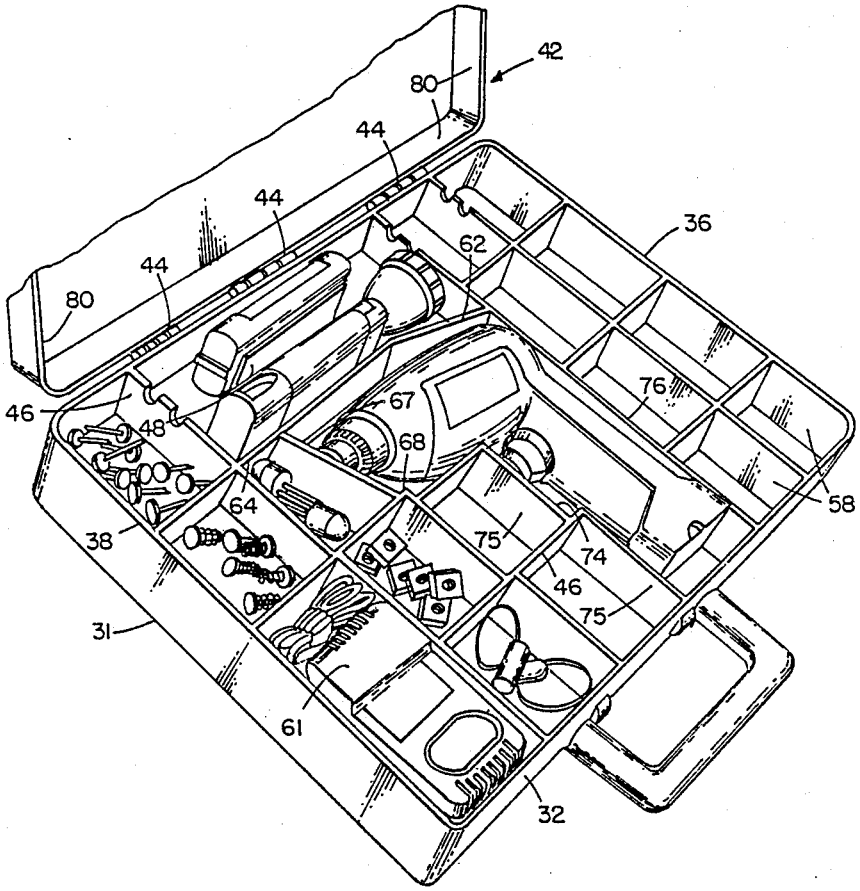
FIG. 4 is a perspective view of the present invention shown having various tools stored therein.
Figure 5:
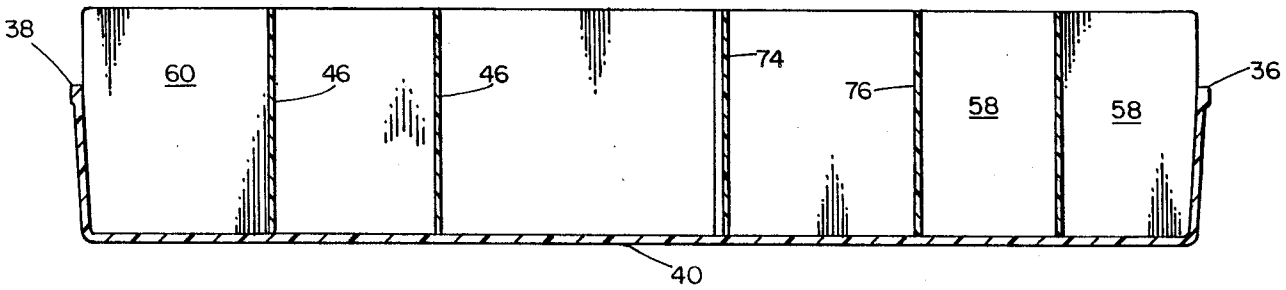
FIG. 5 is a cross sectional view of FIG. 2 taken along lines A—A with the lid open.
Figure 6:
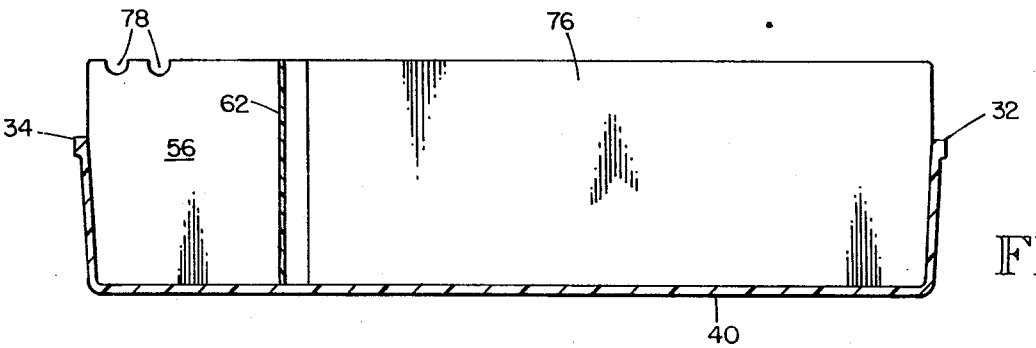
FIG. 6 is a cross sectional view of FIG. 2 taken along lines B—B with the lid open.

The case has a bottom half, 31, and a top half or lid, 42, as shown in FIGS. 3 and 4. The case also has a front wall 32, a rear wall 34 and a right side wall, 36 and a left side wall 38 which are all part of the unitary bottom half. The bottom half has a bottom side 40 as shown in FIGS. 5 and 6. Hinges 44 are used to attach the lid to the unitary bottom half.

Unitary in the sense of this invention means that an item is a single piece made from a single type of material with no fasteners or attachments being part of the unitary device. The bottom half in this invention is a unitary device and the lid is a separate unitary device. When attached together they form a single device but not a unitary device. Each of them remains a unitary device even while being part of the single device that forms the entire case.

A part of the hinges from the bottom half are formed with it as are a part of the hinges formed with the top half or lid. These can be interlocked to form the full hinge attaching the top half to the bottom half to form the single device. The hinges are part of the unitary device of the respective top and bottom parts as are the protuberances for the handle and for the clasps to close the lid. Any type of handle, hinge or lid securing devices can be used as is well known in the art. The handle is attached to the bottom of the case by four separate protuberances, one on each side of the two handle parts that attach to the case. Any one of a number of currently available handles, hinges, clasps, etc. may be used in conjunction with this invention.

The case, both top and bottom, is made from any one of many well known and available molding compounds and techniques. Presently a polyethylene molding compound in an injection mold process is used to make the bottom and top parts of the case, each in their own mold and each being a unitary structure. Other methods of making the case as well as other molding compounds would work and be interchangeable with this method of making the case as is known to those of skill in the art.

The case is made with many compartments, each separated from the other by a partition, labeled generally as 46. The partitions are made as part of the unitary bottom part of the case and can attach to the bottom side and to one or the side walls or another partition to form compartments for retaining devices.

One partition of particular significance is partition 48 because it is a free standing partition. That is, partition 48 is attached to the bottom of the compartment but not to any wall or any other partition. This creates compartments which in turn are part of a larger compartment, 56. The compartment 56 is a single compartment because it is bound on four sides by partitions but it has within it two compartments, 50 and 52, that are defined on either side by the free standing partition 48. Thus part of compartment 56 is in common with compartment 50 and part of it is in common with compartment 52. Compartments 50 and 52 are not in common with each other but are separated by free-standing partition 48.

The compartment 56 is along the rear wall of the case having one of its sides being defined by the rear wall, 34, of the case. Compartment 50 is also defined on one side by the back wall. These are the compartments for the flashlight and spare battery or batteries. This is of particular significance because the rear of the case is somewhat more difficult to reach for the worker and if the worker is having to reach into the rear of the case on a regular basis he will soon become very tired and will find the case very inconvenient to use. The flashlight and battery are low use items for the average worker compared to other items in the case such as the drill, staple gun and fasteners.

One teaching of this invention is to place compartments toward the front and in the easy reach of the worker that will contain high or frequent use items and shape the compartments at the rear for the less frequently used items. The compartments at the front, labeled generally as 58, are shaped to retain high use items such as various fasteners including screws, wire wraps, fuses, wire nuts, bridge clips, electrical tape, tie wraps, clamps, drill bits, wire holders, etc. as well as wire screws, tape measure and other items as shown in FIG. 4. Many of these items are consumed items, that is, they are put into the structure the worker is working on and left in the structure and the worker will restock his case on a periodic basis. Other heavy use items such as wire plugs and tape measure are not consumed but are still often needed by the worker.

Compartment 60 is used during shipping or storage for the battery charger, 61. Often the worker will remove the battery charger from the case and plug it into a wall outlet or automobile 12 volt power supply, such as the cigarette lighter, so it can be used to charge batteries. This will permit the worker to use compartment 60 for certain longer screws that will be needed on a regular basis by the worker. Some workers may desire to use compartment 60 as well as other compartments for storing intermediate length drill bits, nails or other items too long for other compartments but still used on a regular basis. For this reason the compartment 60 is placed near the front of the case, to provide one compartment for easy access to the somewhat longer items that the worker may need.

In the alternative embodiment of FIGS. 3 and 4 all the compartments are rectangular except compartment 56. In a further alternative embodiment, not shown, compartment 56 could be made rectangular if desired, all that would be necessary would be to put partition 62 straight with respect to partition 64.

Figure 7:
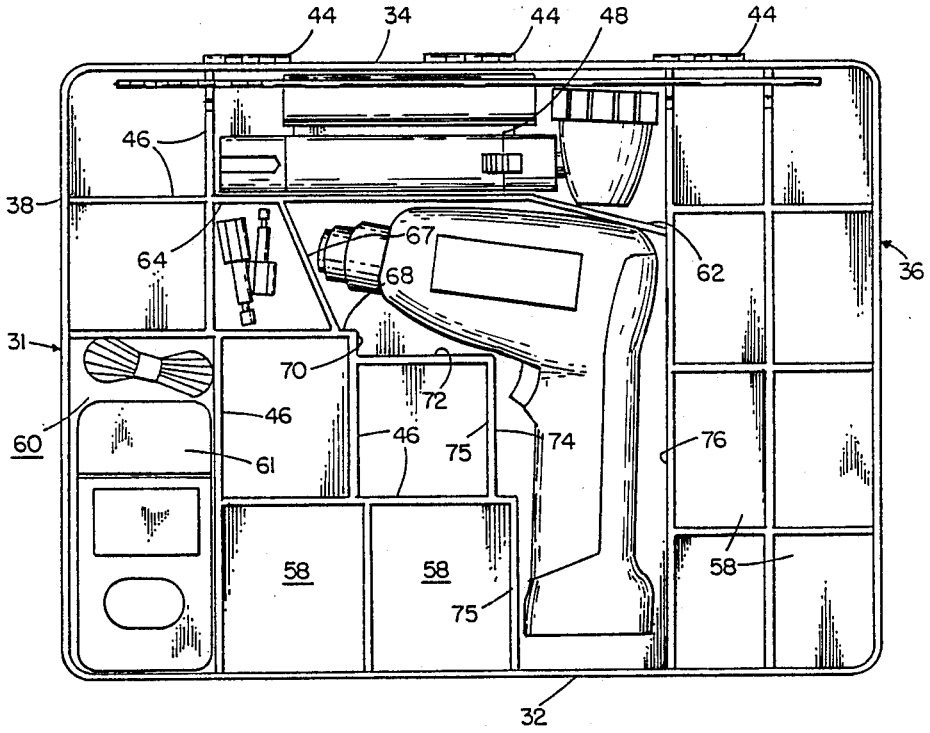
FIG. 7 is an alternative embodiment of a top side view of the present invention having the flashlight head rotated instead of straight.
Figure 8:
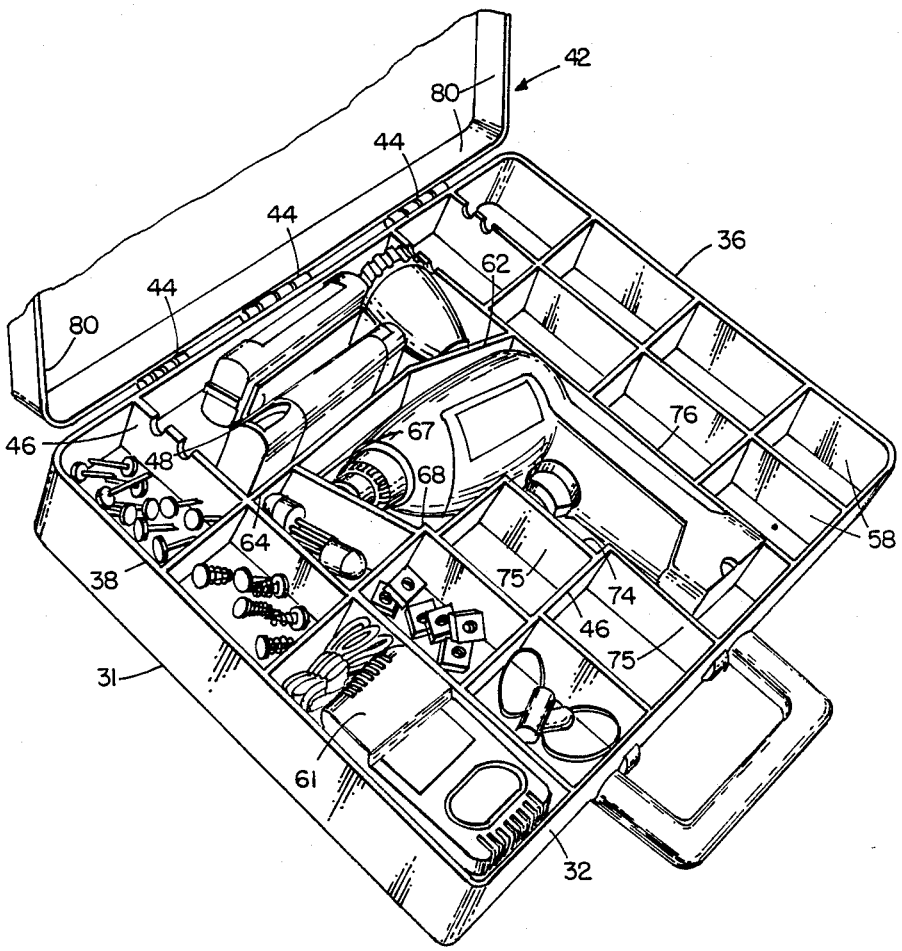
FIG. 8 is an alternative embodiment of a perspective view of the present invention having the flashlight head rotated instead of straight.

In the preferred embodiment partition 62 is on a slant for a particular reason that provides an unexpected benefit. The flashlight of the 9.6 volt system made by Makita has a wider head than the flashlight of the 7.2 volt system. The flashlight of the 7.2 volt system fits fine without need of using a slant in partition 62 if desired but other flashlights do not. Some manufacturers make flashlights with narrow bodies but elliptical or wide heads that fan out. In addition, as shown in FIGS. 7 and 8 the flashlight can be placed in the case with the head rotated 90 degrees if desired. Compartment 56 is specifically designed to hold any one of many different shapes or sizes of flashlights. This is a distinct advantage of the present case.

Further, partition 48 or in the alternative partitions 62 and 64 have fasteners with straps attached to them that can be placed over any size of flashlight or battery to hold them firmly in place even though they may be slightly smaller than the compartment. This strap can be attached by Velcro or by rivets, screws or any well known fastening device. A Velcro strip with a companion strap are presently used in the preferred embodiment. Similarly a strap could be placed on the other side of partition 64, 62 to hold different sizes of drills and staple guns firmly in place as well as placing such straps on other partitions within compartment 30 or 60.

In the presently preferred embodiment the compartments for retaining fasteners or smaller items that are frequently used do not have any type of strap attached as the worker will use and replace these items often. Also of significance as explained herein, the compartments are sealed with respect to each other so that even if the small screws, clamps or various fasteners are not held in place they will not fall out or move into another compartment once the lid is closed. Hence the worker may secure the power tools which are electrically operated devices for extra safety and by closing the lid also secure each item in its place and can turn the case upside down, bounce it, etc. without mixing up the parts or causing them damage. This is a significant advantage of the present invention.

Compartment 30 is the largest compartment in the case. Compartment 30 is about twice as large as the next largest compartment and in one embodiment, not shown is well over twice as large as the largest compartment. Compartment 30 is 3 to 4 times larger in area than the average compartment in the case. This feature of having the compartment 30 about twice as large as any other compartment provides many benefits, some of which are not expected benefits. For example, the case can be made small enough to be used and carried easily by the worker but still be large enough to hold many different sizes of drills and the staple gun at the same time one drill is in the compartment. The numerous smaller compartments permit many different types of fasteners to be carried and kept separate from each other. The contents of the smaller compartments can be refilled each day if desired. The case of FIG. 1 and the case of FIG. 2 have exactly the same outside dimensions in a flat plane, both are 15 inches by 20 inches. Yet, the case of FIG. 2 is significantly better than the case of FIG. 1 in that the present invention while being a convenient size can retain and enclose the largest drills usually used by the worker, the larger flashlight, battery and battery charger as well as many different types and brands of drills, power tools and a staple gun, at the same time. This is all provided in a single case.

Compartment 30 is defined by walls 62, 64, 66, 68, 70, 72, 74, 32 and 76. Wall 32 is a front wall. This compartment is made to hold a staple gun at the same time a drill is held there, the two being held in a nested relationship. The staple gun will be retained by walls 70, 72, 76, 62, and part of wall 64. When a staple gun and drill are stored in the case at the same time the staple gun rests above the drill, touching it and being retained by the walls 70, 72, 76, 62 and 64. The projecting lip 70 is made especially to retain a staple gun in a solid position with the aid of the other walls. The staple gun is also retained and enclosed by the lid when the lid is shut. It is possible if desired to store the staple gun alone in this compartment while the drill is being used or held elsewhere and the particular relationship of the walls ensures that the staple gun will be properly retained. It may also be desirable to place the staple gun on the bottom with drill on top of it, still in the nested relationship, one above the other but the staple gun resting on the bottom of the case, 40, and the drill resting on top of the staple gun with the lid enclosing them both.

FIG. 2 shows walls 74 and 66 as being slanted while FIGS. 3 and 4 show a slightly different alternative embodiment of having corresponding walls, 75 and 67 straight. The presently preferred embodiment is with the slanting wall but either embodiment is suitable for the present invention.

As can be seen by FIGS. 5 and 6 the partitions that make up the compartments, labeled generally as 46 but also labeled with corresponding numbers from FIG. 2 as appropriate, are somewhat higher than the side, rear and front walls that form the outer walls of the case. The case outer walls are 2½ inches high and the partitions are 1⅛ to 1½ inches higher than those in a preferred embodiment. Each of the outer walls has an extending lip 77 to aid in creating a strong and tight seal with the lid when it is closed. The bottom half also has half-circle slots 78 that run the length of the back and are cut into each of the rear partitions to hold extra long drill bits that may be needed by the worker. While only two are shown more could be added if necessary. This particular location is advantageous as the drill bits can be stored in the case and not be in the way. They are stored at the rear of the case over low use items such as the flashlight and thus will not be burdensome to the worker yet will be handy when needed.

In one embodiment the partitions are the same height above the outer walls as the depth of the lid such that when the lid is closed it contacts the top of the partitions very uniformly. This seals the partitions completely and creates an enclosure out of each of the compartments. The sides of lid 42 labeled generally as 80 contact the outer walls of the bottom portion of the case to form a seal with these walls so that the compartments at the edges are sealed and enclosed on all sides as well as the compartment in the inner part of the case. The outer walls of the lid and bottom have been specifically shaped and designed to form a tight seal around all edges when the case is closed in an embodiment. This has benefits not only when shipping the case with tools therein but also for the worker in his daily use in carrying it or moving the case from place to place. This means that once the case is closed it can be inverted or placed on its side or rear walls and each of the items will be enclosed in their respective compartments even if they are very small fasteners, wires or clips. This also means that the worker does not need to worry about small screws damaging his drill or putting unsightly mars or scratches on the flashlight, drill, etc.

In shipping the tools from the supplier to the worker the sealed relationship of the compartments and the tools therein is most helpful in ensuring safe shipment. The case solves a long felt need by the shipper and avoids a previously wasted expense and shipping case. Now the same case that is very convenient and useful for the worker is now made to hold the tools normally shipped in a group by the supplier such as the special set of a drill, flashlight, battery and charger. The worker can retain the shipped case and find great use for it in his daily work.

It would be common for workers using this case to continue to use tool belts of various types if desired. For example, the drill is shipped with a special holster made for fitting to the belt or around the waist of the worker. The worker may hang his drill and other tools or fasteners from his tool belt and lay the case in his truck for the day. On the other hand, the worker will often find it convenient to put one drill on his tool belt and place a different power tool and a staple gun with a very large supply of respective fasteners in the case for use as desired. At the end of the day the drill could be stored in the case for transportation home or other tools stored in the case as desired by the worker.

This tool case could be used as part of a procedure or fastening system by the workers in their daily work. The screws placed therein could be a specially designed hex headed screw with a slot that could be driven in either with a screwdriver type tool or a wrench type tool. The most frequently used screw sizes and tools being placed in the easy to reach respective compartments is part of the total system to permit the worker to very quickly finish his job and go to the next job.

The present invention has been described with respect to a preferred embodiment and numerous other embodiments but is not limited to this embodiment. The invention also includes those devices that are equivalent or made following the teachings of this invention. The present invention has utility not only for storing and using tools but also in their shipping.

I claim:

1. A box for retaining tools and fasteners, comprising:

a bottom section including a rigid bottom, a rigid front wall, rigid side walls and a rigid back wall, said walls extending to a first height perpendicular to said bottom;

a lid section hingedly coupled to said bottom section, having a rigid top, a rigid front wall, rigid side walls and a back wall, said walls extending to a second height perpendicular to said top;

a plurality of rigid partitions extending from said bottom perpendicular to said bottom for a height approximately equal to said first and second height combined to form a plurality of compartments such that when said lid section is closed onto said bottom section with the respective front, side and back walls of said bottom and lid sections contacting each other, said rigid top contacts a top region of said rigid partitions to prevent articles from moving from one compartment to another even though said toolbox is inverted or laid on its side; and said compartments including at least one compartment having a first power tool and a second power tool enclosed therein simultaneously, said at least one compartment being shaped to retain said first power tool having a first size and shape and said second power tool having a different size and shape from said first power tool's size and shape, said first power tool being retained by contacting first and second partitions which form said at least one compartment and said second power tool of a different size and shape being retained by contacting a plurality of partitions, said first and second power tools being enclosed in said box in a nested relationship, said first power tool being enclosed by contacting said rigid bottom, said first and second partitions and said second power tool being enclosed by contacting said rigid top, a plurality of partitions and said first power tool.

2. The box according to claim 1 wherein all of said partitions extend for substantially the same height as each other.

3. The box according to claim 1 wherein said compartments include compartments located adjacent said front wall of said bottom section which are shaped to retain fasteners.

4. The box according to claim 1 wherein said compartments include a compartment shaped to retain an electric drill and a staple gun at the same time.

5. Tools and a toolbox for retaining said tools, comprising:

a bottom section including a rigid bottom, a rigid front wall, rigid side walls, and a rigid back wall, said walls extending perpendicular to said bottom;

a lid section hingedly coupled to said bottom section, having a rigid top, a rigid front wall, rigid side walls, and a back wall;

a plurality of rigid partitions extending from said rigid bottom perpendicular to said bottom to form a first compartment, said first compartment having a projecting lip formed by said partitions and defining a boundary of said compartment; and an electric drill and a staple gun enclosed in a nested relationship within said first compartment, wherein said staple gun overlies said electric drill, said electric drill being enclosed by being restrained by said rigid bottom, and a plurality of partitions of said first compartment and said staple gun, said staple gun being enclosed by being restrained by said rigid top, said projecting lip, and a plurality of partitions and said electric drill.

6. The tools and toolbox according to claim 5 further including a plurality of compartments formed by said plurality of partitions.

* * * * *